US008789553B2

(12) United States Patent
Büttner et al.

(10) Patent No.: US 8,789,553 B2
(45) Date of Patent: Jul. 29, 2014

(54) CONTROL BLOCK COMPRISING AN OIL CHANNEL FOR TEMPERATURE CONTROL

(75) Inventors: Peter Büttner, Lohr (DE); Robert Rüppel, Bischbrunn (DE)

(73) Assignee: Robert Bosch GmbH, Stuttgart (DE)

( * ) Notice: Subject to any disclaimer, the term of this patent is extended or adjusted under 35 U.S.C. 154(b) by 752 days.

(21) Appl. No.: 12/527,212

(22) PCT Filed: Feb. 8, 2008

(86) PCT No.: PCT/DE2008/000242
§ 371 (c)(1),
(2), (4) Date: Dec. 17, 2009

(87) PCT Pub. No.: WO2008/095889
PCT Pub. Date: Aug. 21, 2008

(65) Prior Publication Data

US 2010/0101662 A1 Apr. 29, 2010

(30) Foreign Application Priority Data

Feb. 16, 2007 (DE) ..... 10 2007 008 294

(51) Int. Cl.
*F16K 49/00* (2006.01)

(52) U.S. Cl.
USPC ..... 137/339; 137/884; 60/484

(58) Field of Classification Search
USPC ..... 137/339, 884, 625.69; 60/329, 484; 91/459
See application file for complete search history.

(56) References Cited

U.S. PATENT DOCUMENTS 4,156,560 A * 5/1979 Cheklich et al. ..... 251/30.03
4,373,869 A * 2/1983 Martin et al. ..... 417/213
6,161,586 A * 12/2000 Hirata et al. ..... 137/884

FOREIGN PATENT DOCUMENTS

DE 2949763 A1 6/1980
DE 10056003 * 6/2001
DE 10035575 * 7/2002

OTHER PUBLICATIONS

PCT/DE2008/000242 International Search Report.
PCT/DE2008/000242 International Preliminary Report on Patentability dated Sep. 17, 2009.

* cited by examiner

*Primary Examiner* — Craig Schneider
*Assistant Examiner* — Jonathan Waddy
(74) *Attorney, Agent, or Firm* — Michael Best & Friedrich LLP

(57) ABSTRACT

The present invention relates to a control block provided with a plurality of control block elements in each of which a valve arrangement for controlling an associated hydraulic consumer is provided. Said control block also comprises an oil channel which runs through at least one control block element for controlling the temperature thereof independently of the control of the valve arrangement.

6 Claims, 3 Drawing Sheets

CONTROL BLOCK COMPRISING AN OIL CHANNEL FOR TEMPERATURE CONTROL

BACKGROUND OF THE INVENTION

The invention relates to a control block provided with a plurality of control block elements in each of which a valve arrangement for controlling an associated hydraulic consumer is provided.

SUMMARY OF THE INVENTION

In the document DE 100 35 575 A1 an LS control block is described in which a variable displacement pump is adjusted in response to the maximum load pressure of the actuated hydraulic consumers such that the pump pressure is above the maximum load pressure by a predetermined pressure difference Δp. The pressure medium flows to the hydraulic consumers via adjustable metering orifices at directional valves disposed between a feed line outgoing from the variable displacement pump and the hydraulic consumers. Individual pressure-maintaining valves by which a constant pressure difference is given via the metering orifices irrespective of the load pressures of the hydraulic consumers in the case in which a sufficient amount of pressure medium is supplied by the variable displacement pump are allocated to the directional valves. Thus, the amount of pressure medium flowing to the hydraulic consumer is merely dependent on the orifice cross-section of the respective metering orifice. The pressure-maintaining valves are pressurized in the opening direction by a spring and by the pressure downstream of the respective metering orifice and in the closing direction by the pressure upstream of the respective metering orifice.

When a respective control block according to the state of the art is employed in a truck-mounted concrete pump, the case may arise that in a hydraulically controlled concrete pump the concrete spreader boom is not actuated for a rather long period of time and consequently no pressure medium flows to the control disks for the hydraulic consumers of the spreader boom. The control disks for the spreader boom cool down to the ambient temperature, while the pressure medium flowing in the control block and used for driving the concrete pump has an increased temperature. If a valve provided in a control disk for a segment of the spreader boom is actuated, the hot pressure medium flows into the control disk for the respective spreader boom segment. The slide valve in the control disk is heated, while the housing of the control disk initially has an ambient temperature which may be very low in winter. For instance, the temperature of the pressure medium flowing in the control block is 100° C., while the ambient temperature and consequently the temperature of the portion of the control block housing through which no hot pressure medium is flowing amounts to approximately 10° C. By virtue of such difference in temperature, the slide valve may stick in the housing of the control block.

There is provided a control block comprising a plurality of control block elements each of which includes a valve arrangement for the control of a respective hydraulic consumer, the control block having an oil channel through which oil flows for controlling the temperature of at least one control block element independently of the control of the valve arrangement. Thus, even if a valve disk of the control block has not been actuated for a long time, heating of said valve disk can be ensured so that upon actuation of a valve sticking of the slide valve is prevented.

It is preferred that the oil flow is substantially constant, as in this way uniform heating of the valve housing can be ensured.

It is further preferred that a nozzle is disposed in the oil channel, wherein the nozzle may also be formed by the narrow passage itself or by a constriction of the passage.

It is moreover preferred that a constant pressure difference is provided above the nozzle. This is realized especially by providing a pressure reducing valve between the feed line and the control oil supply passage. By the constant pressure difference formed a constant volume flow of hot oil through the valve housing can be ensured.

In a further development the nozzle is provided in a terminal element of the control block so that a flow through the valve disks located between the input element and the terminal element can be ensured.

The nozzle is preferably disposed in a terminal member of the control block having components for the control oil supply so that a compact design can be imparted to the control block.

In a preferred embodiment the nozzle is provided between a passage pressurized by pump pressure and a low-pressure passage. Passages pressurized by pump pressure frequently have a large cross-section so that a large heat-exchange area is provided.

Furthermore, it is preferred that the nozzle is disposed between a control oil supply passage and a low-pressure passage. In this way, a pressure loss due to the oil flow for heating can be kept at a low value.

The nozzle may also be provided between a control oil supply passage and a tank passage for the working pressure medium. By virtue of the large diameter of the tank passage a uniform heating can take place.

In a further development, the nozzle is formed between a control oil supply passage and a passage for outgoing control oil which is substantially under atmospheric pressure so that no additional passage is required for heating the valve housing.

In an embodiment the nozzle is disposed between an auxiliary passage connected to a pump connection of the control block when the main pump passage is blocked and a low-pressure passage so as to ensure heating of the valve housing even when the main pump passage is blocked.

BRIEF DESCRIPTION OF THE DRAWINGS

Hereinafter the invention is illustrated by way of schematic drawings, in which.

DETAILED DESCRIPTION

Figure 1:
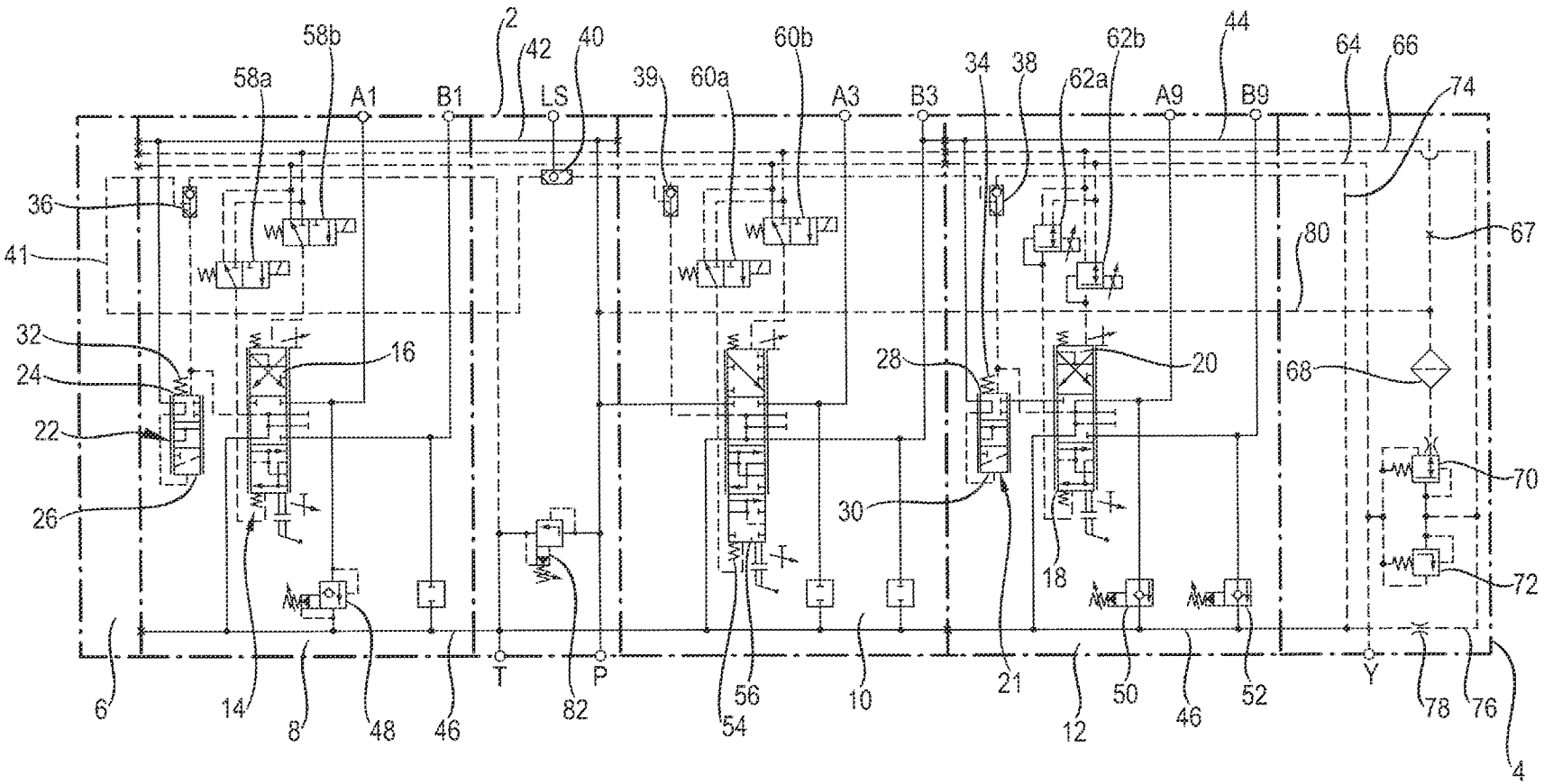
FIG. 1 shows a control block according to the invention comprising a plurality of control block elements in accordance with the first embodiment of the invention.

FIG. 1 shows an LS control block according to the first embodiment including an input disk 2, a control oil supply disk 4 and a terminal disk 6. Between the input disk 2 and the terminal disk 6 a directional valve disk 8 is disposed which is used in a truck-mounted concrete pump, for instance, for the control of the concrete pump connected to the directional valve disk 8 via the ports A1 and B1. Between the input disk 2 and the control oil supply disk 4 two directional valve disks 10, 12 are located which serve for actuating further hydraulic consumers of the concrete pump via ports A3 and B3 and via the ports A9 and B9, for example for actuating hydraulic cylinders at the spreader boom or supports of the truck-mounted concrete pump.

A pump port P, a tank port T and a load-sensing port LS by which the maximum load pressure of the hydraulic consumers controlled by the control block can be tapped off are disposed at the input disk 2. Pressure medium is supplied to the control block from a hydraulic pump not shown in FIG. 1 through the pump port P, while the tank port T is connected to a tank not shown in FIG. 1. A control oil tank port Y is provided at the control oil supply disk 4.

Further, in the input disk 2 a pressure limiting valve 82 is arranged between the pump port P and the tank port T so that the pressure prevailing in a feed line 42 connected to the pump port P cannot exceed the pressure adjusted at the pressure limiting valve 82. A shuttle valve 40 disposed in the input disk 2 is in pressure fluid communication with shuttle valves 36, 38, 39 of the directional valve disks 8, 10, 12 so that the maximum load pressure is applied to the load-sensing port LS of the input disk. For the pressure fluid communication between the shuttle valve 40 in the input disk and the shuttle valve 38 in the directional valve disk 8, a connecting passage 41 is disposed in the terminal disk 6 arranged at the side of the directional valve disk 8 opposed to the input disk 2.

The directional valve disks 8 and 12 include respective directional valves 14, 18, the control pistons of which are adjustable by associated pressure limiting valves, and an associated pressure-maintaining valve 21, 22. The pressure-maintaining valves 21, 22 are pressurized in the opening direction by a pressure spring 32, 34 and the pressure downstream of the respective metering orifice formed at the directional valve 14, 18 and in the closing direction by a control pressure upstream of the respective metering orifice. The maximum load pressure of all simultaneously actuated hydraulic consumers is tapped by the shuttle valves 36, 38 and 39 of the directional valve disks 8, and 12 and the shuttle valve 40 and is transmitted to the pump. The variable displacement pump, not shown in FIG. 1, which is connected to the pump port P is adjusted by the sensed load pressure so that the pump pressure is above the sensed maximum load pressure by a particular pressure difference $\Delta p$. If a pressure difference of 20 bars is adjusted, for instance, in the case that no load pressure is sensed a pressure of 20 bars is prevailing at the pump port P of the input disk 2, otherwise a pressure exceeding the maximum load pressure by 20 bars is prevailing.

The feed line 42 hydraulically connected to the pump port P of the input disk 2 passes pressure fluid to the input of the pressure-maintaining valve 22 which can use the pressure fluid through the directional valve 14 to control a hydraulic consumer via working ports A1 and B1.

The directional valve disk 10 includes a directional valve 54 through which the pressure fluid communication can be switched from the feed line 42 to a working port A3 or a working port B3 and a feed line 44 which is in fluid communication with the working port B3. No pressure-maintaining valve is arranged upstream of the directional valve 54.

The feed line 44 adapted to be hydraulically connected to the pump port P of the input disk 2 via the directional valve disk 10 passes pressure medium to the input of the pressure-maintaining valve 21 which can use the pressure fluid via the directional valve 18 to control a hydraulic consumer via working ports A9 and B9.

Moreover, a discharge passage 46 connected to the tank port T at the input disk 2 passes through the directional valve disks 8, 10, 12, extends into the control oil supply disk 4 and is part of a discharge path through which pressure fluid can flow back from the discharge ports of the directional valves 14, 18, 54 to the tank port T in the input disk 2.

In the idle position of the directional valve 54 of the directional valve disk 10 shown in FIG. 1 a pressure fluid communication is provided between the feed line 44 in the directional valve disk 12 and the discharge passage 46. In this way, supply of pressure medium from the feed line 42 to the working ports A9, B9 at the directional valve disk 12 is prevented. By virtue of said idle position the directional valve disk 10 has the function of a safety member.

In the control oil supply disk 4 connected to the directional valve disk 12 a filter 68, a pressure reducing valve 70, a pressure limiting valve 72 and a nozzle 78 are formed. The pressure fluid communication between the feed line 44 extending in portions in the control oil supply disk 4 and the filter 68 the discharge port of which is connected via a pressure reducing valve 70 to the control oil supply passage 66 extending in the input disk 2 and the directional valve disks 8, 10, 12 is blocked by a plug 67. A pressure limiting valve 72 is provided between the control oil supply passage 66 and a control oil tank passage 64 extending in the input disk 2 and the directional valve disks 8, 10, 12. In the spring-biased pressure chambers of the pressure reducing valve 70 and the pressure limiting valve 72 the pressure is prevailing in the control oil tank passage 64, whereas in the control chambers of the pressure reducing valve 70 and the pressure limiting valve 72 acting in opposite direction the pressure is applied to the control oil supply passage 66. The pressure reducing valve 70 controls a fixed control oil supply pressure in the passage 66. The pressure limiting valve 72 has a safety function. The fixed pressure is 30 bars, for instance.

A load-sensing line 74 connected to the shuttle valve 36 of the shuttle valve cascade in the control oil supply disk 4 is connected to the discharge passage 46. Thus, the tank pressure is applied to the load-sensing line 74 and, consequently, to an input of the shuttle valve 36 of the directional valve disk 12.

In the first embodiment of the present invention an oil channel 76 including the nozzle 78 is disposed between the control oil supply passage 66 and the discharge passage 46 in which substantially tank pressure is prevailing. Furthermore, in the input disk 2 and in the directional valve disks 10 and 12 as well as in the control oil supply disk 4 an auxiliary passage 80 is formed which, on the one hand, is in pressure fluid communication with the feed line 42 and, on the other hand, is connected to the input port of the filter 68. Oil flows through said auxiliary passage 80, independently of whether the directional valve 54 is actuated in the directional valve disk 10, from the feed line 42 via the filter 68 and the pressure reducing valve 70 to the control oil supply passage 66 and from there via the oil channel 76 including the nozzle 78 to the discharge passage 46. Thus, independently of whether the feed lines 42 and 44 are interconnected via the directional valve disk 10, pressure medium flows in the directional valve disks 10 and 12 and heats the latter. The directional valve disks are also heated due to the pressure medium flow in the discharge passage 46. This has the advantage that, by virtue of the large diameter of the discharge passages 46 in the control block, good heat transfer can take place from the oil to the housing of the control block. As a result, the control piston of the directional valve 18 can be prevented from sticking.

The auxiliary passage 80 is not provided in the directional valve disks solely for an oil flow passing through the same to heat the directional valve disks. A corresponding passage is also recognized in the directional valve disk 8. There it serves for applying the load pressure from the terminal disk 6 to the one input of the shuttle valve 40 of the input disk 2. In general, the passage 80 in the directional valve disks serves for applying, even in the case of plural directional valve disks arranged between the one side of the input disk 2 and a terminal disk 6, the maximum load pressure of hydraulic consumers simultaneously actuated by said directional valve disks which is selected via shuttle valves of said directional valve disks to the one input of the shuttle valve 40.

Oil flows from the auxiliary passage 80 in the directional valve disks 10 and 12 via the filter 68, the pressure reducing valve 70 and the nozzle 78 into the discharge passages 46 in which tank pressure is prevailing. Since the pressure reducing valve 70 adjusts a particular pressure in the control oil supply passage 66 located upstream of the nozzle 78, the pressures upstream and downstream of the nozzle 78 and thus the pressure difference across the nozzle 78 are constant. That is to say, the oil flow for heating the directional valve disks 10 and 12 is constant and does not depend on the pump pressure. The oil flow can be adjusted by appropriately selecting a nozzle 78 having a particular flow cross-section. However, a precondition for a constant oil flow for heating is the plug 67 that prevents the oil from flowing from the auxiliary passage 80 through the feed line 44 and the non-actuated directional valve 54 to the tank port T of the input disk 2. Without the plug 67 the oil flow provided for heating the directional valve disks 10 and 12 would be dependent on the pump pressure.

Through the auxiliary passage 80, the oil flowing off through the discharge passages 46 and heating the directional valve disks 10, 12 and also the oil removed from the control oil supply passage by the pilot valves for controlling the directional valves, flows to the control oil supply disk 4. The supply of the pressure input of the pressure reducing valve 70 with pressurized oil would not be ensured without the plug 67.

In FIG. 1 only two directional valve disks are shown between the input disk 2 and the control oil supply disk 4. Of course, even more, for instance seven directional valve disks may be arranged there. Equally, more than one directional valve disk may be provided between the input disk 2 and the terminal disk 6.

Figure 2:
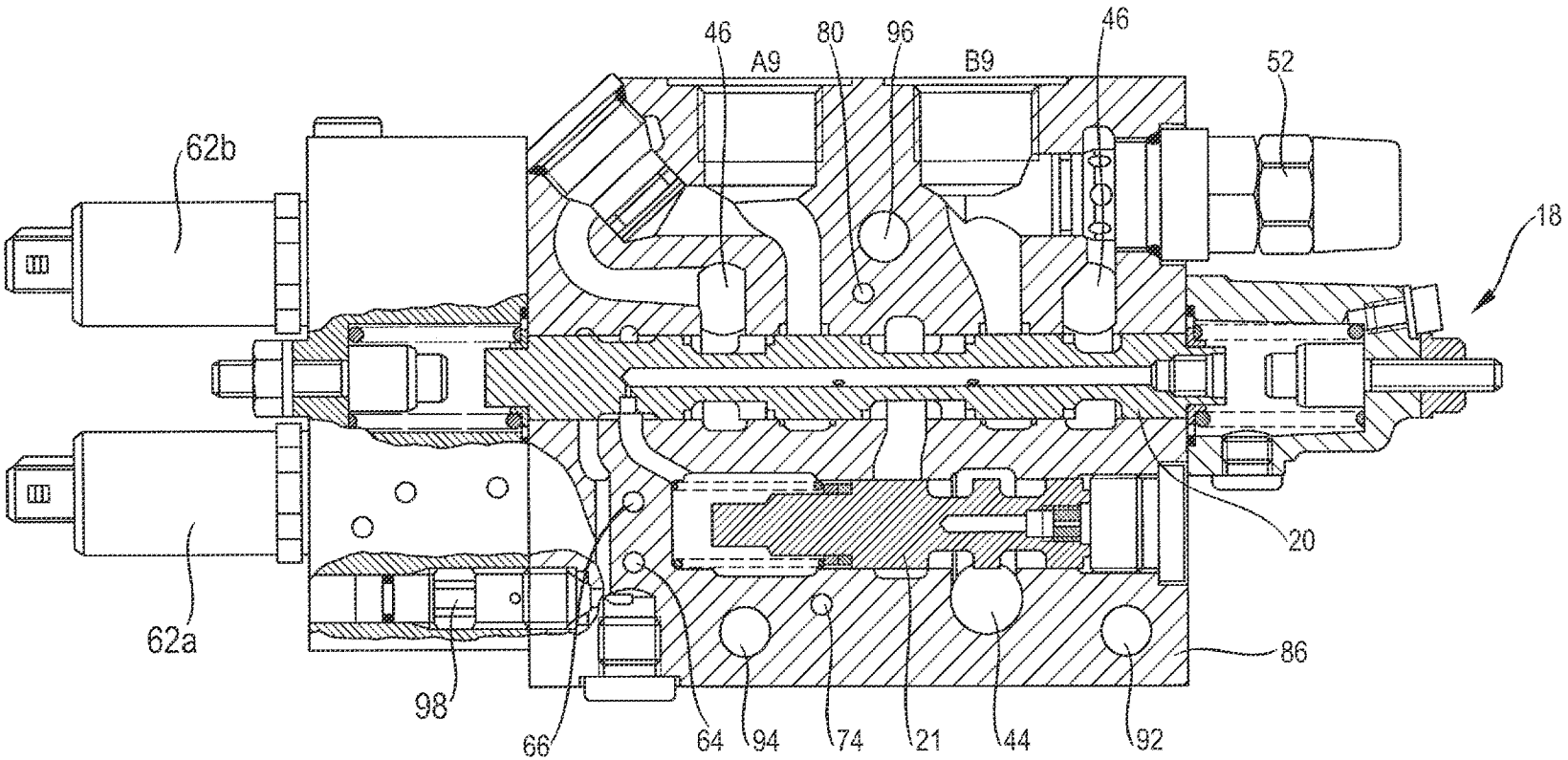
FIG. 2 is a sectional view across a control disk for a control block in accordance with the first embodiment.

FIG. 2 shows a sectional view across the valve housing 86 of the directional valve disk 12 of the first embodiment.

One can take from FIG. 2 that the control piston 20 is supported in the valve housing 86 and is capable of providing a pressure fluid communication between the feed port P and the advance port A9 and the return port B9. On both sides of the control piston 20 discharge passages 46 are provided. The advance port A of the directional valve 18 is in pressure fluid communication via a pressure limiting and pre-fill valve not shown in FIG. 2 which in FIG. 1 is marked by the reference numeral 50, while the return port B is in pressure fluid communication with the discharge passage 46 via the pressure limiting and pre-fill valve 52.

The individual pressure-maintaining valve 21 the inlet of which is in pressure fluid communication with the feed line 44 is arranged upstream of the directional valve 18. The pilot valves 62*a*, 62*b* cause, as described in the foregoing, an adjustment of the control piston 20 into the working positions a, b and into the idle position 0. The control oil is supplied to the pilot valves 62*a*, 62*b* through the control oil supply passage 66 having the cross-section shown in FIG. 2. The load-sensing line 74 is disposed below the pressure-maintaining valve in FIG. 2. Adjacent to the two end portions of the pressure-maintaining valve 21 and at the side of the load-sensing line 74, recesses 92 and 94 are provided for tie rods holding the control block together. A further tie rod recess 96 is provided in the valve housing 86 between the ports A9 and B9 adjacent to the auxiliary passage 80 above the control piston 20. Adjacent to the control oil channels 64, 66, a pressure limiting valve 98 is introduced in the valve housing 86 for limiting the load pressure sensed to the spring chamber of the pressure-maintaining valve 21 when the control piston deflects to the one direction.

As can be taken from FIG. 2, the diameter of the discharge passages 46 is large, wherefrom an efficient heating of the valve housing 86 by means of the oil channel 76 is resulting in accordance with the first embodiment. The hot oil moreover flows through the two discharge passages 46 so that the directional valve disks are uniformly heated.

Figure 4:
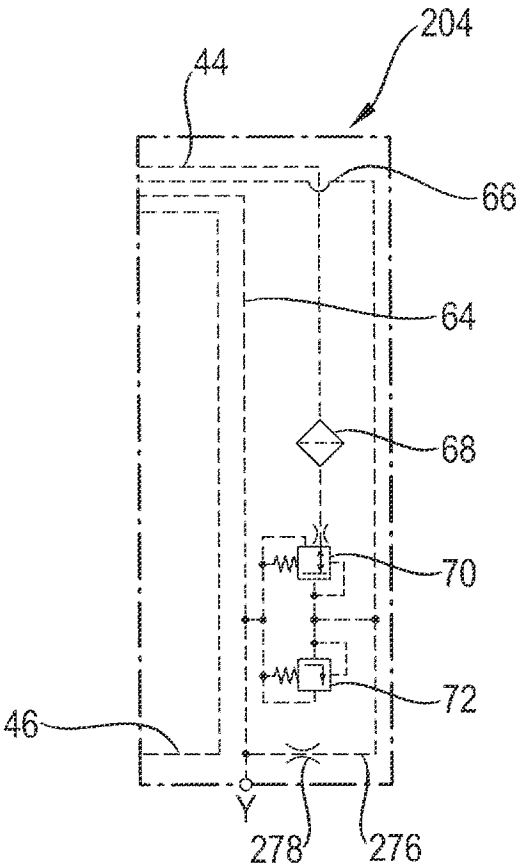
FIG. 3 shows a control oil supply disk of a control block in accordance with a second embodiment of the invention and FIG. 4 shows a control oil supply disk of a control block according to a third embodiment of the invention.
Figure 3:
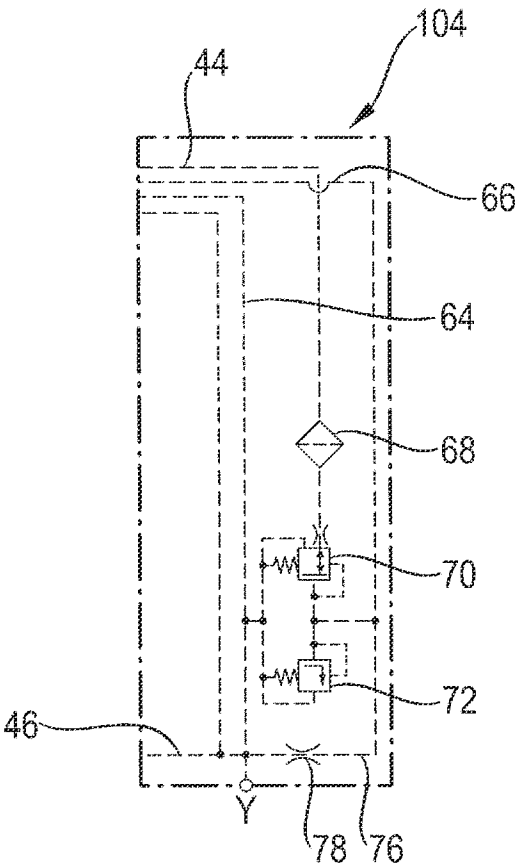

The FIGS. 3 and 4 show a control oil supply disk 104 and 204, respectively, in accordance with the second and third embodiment of the invention.

The control oil supply disk 104 in accordance with the second embodiment shown in FIG. 3 differs from the control oil supply disk 4 of the first embodiment by the fact that no auxiliary passage 80 is provided in the control oil supply disk 104 and that the plug 67 of the first embodiment is removed so that the feed line 44 and the inlet port of the filter 68 are in pressure fluid communication. Said control oil supply disks 104 are employed where a safety function comparable to the directional valve disk 10 of the first embodiment, by which a pressure fluid communication between the feed lines 42 and 44 can be blocked and the line 44 can be connected to the tank, is not provided. Otherwise, in respect of the second embodiment, the description of the control oil supply disk 4 of the first embodiment is referred to.

In the third embodiment shown in FIG. 4 which represents a modification of the second embodiment and in which thus also a constant pressure fluid communication is provided between the feed line 44 and the inlet of the filter 68, an oil channel 276 including a nozzle 278 is provided between the control oil supply passage 66 and the control oil tank passage 64. The control oil tank passage 64 shown in FIG. 4 is the passage for outgoing control oil and substantially atmospheric pressure is prevailing in the same. The valve housing is thus heated by the oil inflowing via the feed line 44 of the nozzle 278.

The first to third embodiments have in common that there may be provided a constant pressure difference above the nozzles 78, 278 and a defined oil flow through the passage 76, 276. This is ensured especially by the constant control oil supply pressure prevailing in the control oil supply passage 66.

The present invention relates to a control block comprising a plurality of control block elements in each of which a respective valve arrangement is provided for controlling an associated hydraulic consumer. In the control block furthermore an oil channel is provided which runs through at least one control block element for controlling the temperature thereof independently of the control of the valve arrangement.

LIST OF REFERENCE NUMERALS

2 input disk
4 control oil supply disk
6 terminal disk
8 directional valve disk
10 directional valve disk
12 directional valve disk
14 directional valve
18 directional valve
20 control piston

21 individual pressure-maintaining valve
22 individual pressure-maintaining valve
36 shuttle valve
38 shuttle valve
39 shuttle valve
40 shuttle valve
41 connecting passage
42 feed line
44 feed line
46 discharge passage
48 pressure limiting and pre-fill valve
50 pressure limiting and pre-fill valve
52 pressure limiting and pre-fill valve
54 directional valve
56 control piston
62*a, b* pilot valve
64 control oil tank passage
66 control oil supply passage
67 plug
68 filter
70 pressure reducing valve
72 pressure limiting valve
74 load-sensing line
76 oil channel
78 nozzle
80 auxiliary passage
82 pressure limiting valve
86 valve housing
92 tie rod recess
94 tie rod recess
96 tie rod recess
98 pressure limiting valve
104 control oil supply disk
176 oil channel
178 nozzle
204 control oil supply disk
276 oil channel
278 nozzle

The invention claimed is:

1. A control block comprising a plurality of control block elements in each of which a valve arrangement for controlling an associated hydraulic consumer is provided, characterized by an oil channel through which oil flows for controlling the temperature of at least one control block element independently of the control of the valve arrangement, wherein a nozzle is arranged in the oil channel, and a constant pressure difference is produced across the nozzle by a pressure reducing valve provided between a feed line and a control oil supply passage such that a constant volume flow of hot oil flows through the nozzle, wherein the nozzle is arranged in a terminal element of the control block including the pressure reducing valve and a pressure limiting valve for control oil supply.

2. A control block according to claim 1, wherein the nozzle is provided between the control oil supply passage and a low-pressure passage.

3. A control block according to claim 1, wherein a main pump passage leading to the nozzle is blocked, and wherein the nozzle is arranged to receive flow via an auxiliary passage fluidly coupled between a pump port of the hydraulic control arrangement and a low-pressure passage.

4. A control block according to claim 1, wherein the nozzle is provided between the feed line pressurized with pump pressure and a low-pressure passage.

5. A control block according to claim 4, wherein the low-pressure passage is a tank passage for the working medium.

6. A control block according to claim 4, wherein the nozzle is provided between the control oil supply passage and a passage substantially under atmospheric pressure for outflowing control oil.

* * * * *